United States Patent [19]

Sequeira

[11] Patent Number: 4,677,404

[45] Date of Patent: Jun. 30, 1987

[54] COMPOUND DIELECTRIC MULTI-CONDUCTOR TRANSMISSION LINE

[75] Inventor: Hermann B. Sequeira, Baltimore, Md.

[73] Assignee: Martin Marietta Corporation, Bethesda, Md.

[21] Appl. No.: 683,535

[22] Filed: Dec. 19, 1984

[51] Int. Cl.[4] ..... H01P 3/18

[52] U.S. Cl. ..... 333/238; 333/239

[58] Field of Search ..... 333/238, 239, 250; 350/96.30, 96.32

[56] References Cited

U.S. PATENT DOCUMENTS

| | | | |
|---|---|---|---|
| 3,563,630 | 2/1971 | Anderson et al. | 333/238 X |
| 3,903,488 | 9/1975 | Fong | 333/238 |
| 3,944,950 | 3/1976 | Jacobs et al. | 333/250 X |
| 3,986,153 | 10/1976 | Kuno et al. | 333/239 X |
| 4,028,643 | 6/1977 | Itoh | 333/238 X |
| 4,053,897 | 10/1977 | Nerheim | 331/107 DP X |
| 4,380,020 | 4/1983 | Yuan et al. | 333/247 X |
| 4,463,330 | 7/1984 | Yoneyama | 333/239 |
| 4,490,700 | 12/1984 | Stern et al. | 333/239 X |

FOREIGN PATENT DOCUMENTS

| | | | |
|---|---|---|---|
| 2292347 | 6/1976 | France | 333/239 |

*Primary Examiner*—Eugene R. LaRoche
*Assistant Examiner*—Benny T. Lee
*Attorney, Agent, or Firm*—James B. Eisel; Gay Chin

[57] ABSTRACT

This is a transmission line particularly suitable for millimeter-wave transmission that comprises a dielectric guiding slab layer sandwiched between a dielectric substrate layer and a dielectric strip, the long axis of the dielectric strip defining the direction of transmission. The outer surfaces of the strip and the substrate are clad with a conducting layer.

7 Claims, 5 Drawing Figures

COMPOUND DIELECTRIC MULTI-CONDUCTOR TRANSMISSION LINE

TECHNICAL FIELD

Guided wave transmission lines are widely used to channel the flow of high-frequency electrical energy. Common examples of these are the coaxial line, the hollow metallic waveguide and the optical fiber. All these waveguiding structures are useful in long-link applications.

In situations where the distance between the transmitting and receiving points is below a few inches, as in an integrated circuit, planar transmission lines offer an attractive alternative to the long-haul transmission lines named above. A variety of planar transmission line configurations are possible. In general, all of these offer significant savings in size and weight over the non-planar varieties. Further, monolithic and hybrid technologies are closely compatible with the planar configuration. Consequently, these technologies can be used to generate with high reproducibility, systems which offer superior performance and enhanced reliability. When combined with high-volume batch fabrication, significant cost savings can also result.

BRIEF DESCRIPTION OF THE DRAWINGS

FIG. 1 shows prior art transmission lines in which metallic conductors play a primary role in the waveguiding process:

FIG. 2 shows prior art transmission lines in which a dielectric strip plays a primary role in the waveguiding process:

DESCRIPTION OF THE PRIOR ART

Figure 1A:
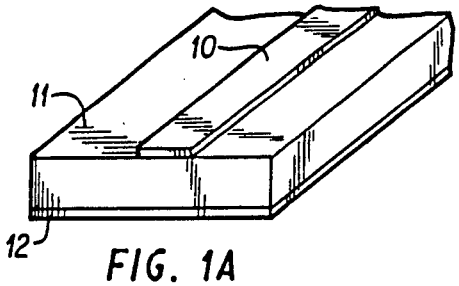
FIG. 1A PRIOR ART
FIG. 1*a* shows a microstrip line.
Figure 1B:
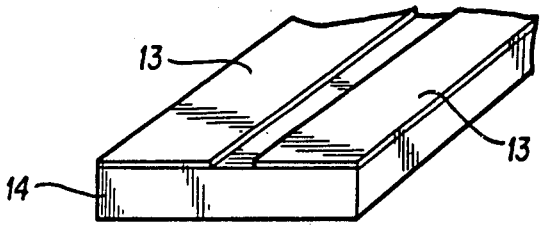
FIG. 1B PRIOR ART
FIG. 1*b* shows a slotline.
Figure 1C:
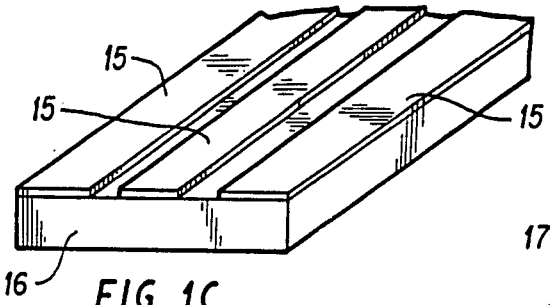
FIG. 1C PRIOR ART
FIG. 1*c* shows a coplanar waveguide.
Figure 1D:
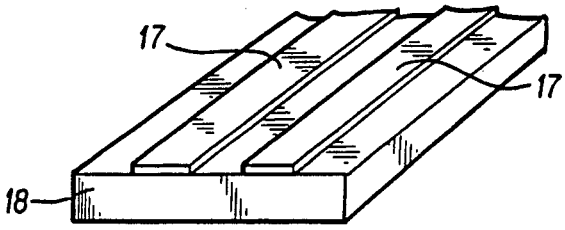
FIG. 1D PRIOR ART
FIG. 1*d* shows coplanar strips.

The development of planar waveguiding structures for millimeter (mm)-wave applications has been proceeding for about two decades.

An important concept in waveguiding is the notion of a mode. A mode is a spatial distribution of energy across the cross-section of the guiding structure. In general, a waveguiding structure can propagate several modes. Each of the modes has a characteristic cut-off frequency below which the waveguiding structure will not support it. It is customary to choose the cross sectional dimensions of the waveguiding structure such that, over the frequency range of interest, only one mode will be supported. This mode is often the one with the lowest cut-off frequency and is called the dominant mode. The range of frequencies between the cut-off for the dominant mode and the cut-off for the next higher order mode represents the useful bandwidth for the waveguiding structure. It is customary to design structures for the widest possible bandwidth consistent with single-mode operation as described above.

An important consideration in the design of a planar structure is the nature and behavior of the so-called substrate modes. These are undesirable parasitic modes that, if allowed to propagate, can cause severe transmission losses, especially at waveguide bends and discontinuities.

In the structures shown in FIG. 1, metallic strips are of primary importance in the waveguiding process. In the microstrip line of FIG. 1*a*, a conducting strip 10 is mounted on a dielectric 11 which is coated on its bottom surface with a metallic ground plane 12. In the slotline of FIG. 1*b*, two parallel conductors 13 are placed upon dielectric 14. In FIG. 1*c*, a coplanar waveguide configuration is shown in which three parallel conductors 15 are placed on dielectric 16, the two outer conductive strips acting as a ground plane. In FIG. 1*d*, coplanar conductive strips 17 are mounted on dielectric 18, but the edges of the strips are not coextensive with the edges of the dielectric slab, as they were in the slotline of FIG. 1*b*.

The microstrip shown in FIG. 1*a* has proven the most versatile and successful among the prior art configurations using metallic strips. Microstrip has been successfully used in applications up to 60 GHz, but even at those frequencies, some of the problems associated with its use are evident.

In microstrip, the substrate modes are suppressed by choosing a dielectric substrate that is thin enough. At 60 GHz, a typical substrate thickness must not exceed 8 mils. At higher frequencies, even thinner substrates must be used.

The requirement of thin substrates bears important consequences for the electrical and mechanical properties of the microstrip structure. The impedance of a transmission line in microstrip is primarily determined by the ratio of the conductor strip width W, to the dielectric thickness h, i.e., W/h. The value of W is bounded at the upper end by the requirement that it be small compared to the wavelength of the propagating energy at the frequency in question. The lower bound on W is determined by the accuracy and reproducibility with which a narrow line can be fabricated. These bounds in turn limit the range of line impedances available to the circuit designer. Consequently, the versatility of the structure is limited when very thin dielectric substrates are used.

Another serious problem is transmission line loss. In microstrip, this loss is dominated by the ohmic losses in the metal conductors. These losses inherently increase with frequency, and, in microstrip, are made to increase even more rapidly as thinner dielectric substrates are used.

A third problem is related to fabrication. The thin substrates required make for very delicate in-process handling. Such processing conditions can result in poor fabrication yields.

A fourth problem concerns the thermal properties of the structure. Ironically this consideration leads to the conclusion that the substrate is not thin enough. If the dielectric substrate is a semiconductor on which truly planar transmitting sources are integrated, then, the heat generated within these sources would have to be removed if the device is to survive operation. Unfortunately, most electrical insulators are also thermal insulators (diamond and beryllium oxide are exceptions), and consequently, the heat generating device would be thermally isolated from a heat sink, unless the substrate was made very thin.

Several attempts have been made to reduce the impact of the above drawbacks, by inserting these substrates into waveguide enclosures to form fin-line and suspended-substrate-stripline configurations. However, these structures are limited by the dimensions of the waveguide enclosures in which they are housed. Besides, the advantages of size and weight are compromised somewhat, and the thermal problem is left unaddressed.

The shortcomings of microstrip are described in Pucel, R. A., "Design Considerations for Monolithic Microwave Circuits," IEEE Trans., Vol. MTT-29, no. 6, pp. 513–534, June 1981.

Figure 2A:
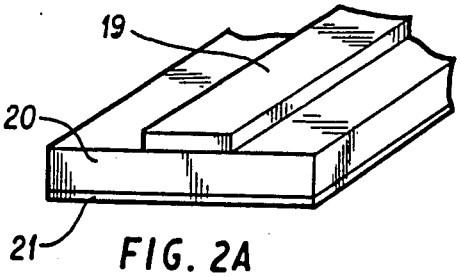
FIG. 2A PRIOR ART
FIG. 2*a* shows a dielectric strip guide.
Figure 2B:
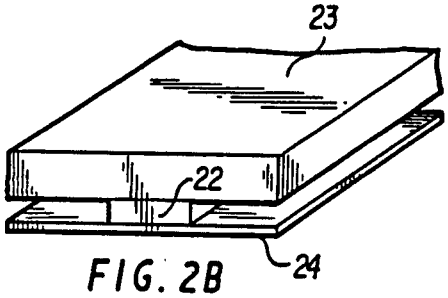
FIG. 2B PRIOR ART
FIG. 2*b* shows an inverted strip guide.

Another class of waveguides, planar dielectric waveguides, offer more convenient substrate and guide dimensions, and also have low loss. In FIG. 2*a*, a dielectric strip guide is shown in which a dielectric strip 19 is mounted on a dielectric slab 20 which is coated on its bottom surface with metallic ground plane 21. An inverted strip guide is shown in FIG. 2*b* in which dielectric strip 22 is sandwiched between dielectric slab 23 and metallic ground plane 24.

Figure 3:
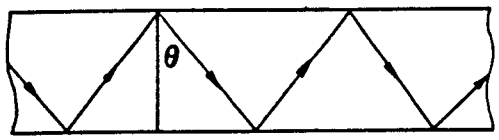
FIG. 3 shows schematically a guided wave mode in a slab waveguide.

A key feature of planar dielectric structures is that they have very low loss at frequencies where the structures of FIG. 1 cannot be used at all. Thus, planar dielectric waveguides have been used at optical frequencies spanning the infrared to visible range. This is in part due to the outright absence of conductors or the relative remoteness of the conductor surfaces from the propagating energy. An elementary way of perceiving the guiding process is illustrated in FIG. 3. In this discussion, the terms "dense," or "optically dense," refer to the property of having a higher index of refraction, and the terms "rare," or "optically rare," refer to the property of having a lower index of refraction. If light in an optically denser medium is incident on an interface with a relatively rarer medium, then total internal reflection off the interface occurs whenever the angle of incidence $\theta$ in the denser medium exceeds a certain critical angle. This critical angle is characteristic of the pair of materials forming the interface. If a slab of optically dense material e.g., glass is sandwiched by optically rarer medium e.g., air, then waveguiding is possible by total internal reflection off both interfaces. The optically dense medium is called the guiding layer; the bounding rarer medium is called the cladding layer. The structure is appropriately called a slab waveguide.

All of the planar dielectric structures of FIG. 2 suffer from the malaise of being multi-mode. They all support at least two modes. Any attempt to realize single mode operation usually results in a mode that is too weakly bound to the structure to be of any practical use.

The very close separation in the cut-off frequencies between the dominant $TM_o$ mode and the next higher $TE_o$ mode forces either an acceptance of a very narrow band waveguiding structure, or a dual-mode guide. The coupling between these two modes can result in high radiation loss at discontinuities and bends, as well as increased coupling to the spurious substrate modes mentioned in connection with microstrip.

A second disadvantage of planar dielectric structures is their extreme sensitivity to the condition of the interface. Thus, any roughness in the surfaces of the guiding or cladding media or any bubbles trapped between them during the bonding process can have a profound influence on the losses due to random scattering from these centers at the boundaries.

SUMMARY OF THE INVENTION

This invention overcomes these difficulties by using a multi-dielectric slab structure bounded on the one side by a metal ground plane. A dielectric strip metallized on the top face forms the remainder of the structure. The layers of dielectric are primarily chosen to keep the propagating energy away from the conductor surfaces, and thereby reduce conductor losses.

DESCRIPTION OF THE INVENTION

Figure 4:
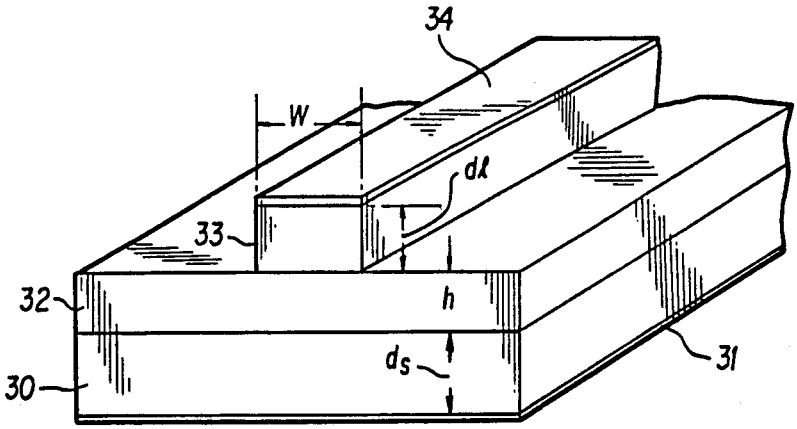
FIG. 4 shows one embodiment of the compound dielectric multi-conductor transmission line of this invention.

As shown in FIG. 4, a substrate dielectric layer 30 with permittivity $\epsilon_s$ and thickness $d_s$ is clad on one side by a metal ground layer 31. The other side of the substrate is bonded to a dielectric guiding slab layer 32 whose permittivity is $\epsilon_g$ and whose thickness is h. A dielectric strip 33 of width W, thickness $d_1$ and permittivity $\epsilon_1$ is bonded to the other side of guiding slab 32. The propagating direction for the electrical energy is along its longitudinal axis. The upper face of strip 33 is clad with a metal layer 34.

The permittivity $\epsilon_g$ of the guiding layer 32 must be greater than both the permittivity $\epsilon_s$ of the substrate 30 and the permittivity $\epsilon_1$ of strip 33. The nature and thickness of metal ground layer 31 and metal layer 34 cladding strip 33 are not critical.

A waveguide in accordance with this invention was constructed with a guiding slab layer 32 of RT Duroid 6010 and both the substrate dielectric 30 and strip 33 of alumina. Duroid is a trademark of Rogers Corp. for filled tetrafluoroeythylene material. The permittivities and dimensions were as follows:

$$\epsilon_g = 10.6\ \epsilon_o$$

$$\epsilon_1 = \epsilon_s = 9.7\ \epsilon_o$$

where $\epsilon_o$ is the permittivity of free space;

$h = 0.025''$ $d_1 = d_s = 0.020''$

When the permittivities of the substrate and strip are equal, $\epsilon_1 = \epsilon_s$, the preferable ratio between each of the thicknesses of the substrate and strip and that of the guiding slab layer is $\frac{3}{4}$ approximately. In the example described above, for practical reasons the thickness ratio was altered to 4/5.

The line loss in this waveguide was measured at 94 GHz and was found to be only 0.4 db/inch, compared with a loss of 2.5 db/inch at that frequency for microstrip, an improvement of almost six to one.

This waveguide transmission line combines the wideband feature of microstrip and the low loss characteristic of planar dielectric waveguides. Like the planar dielectric waveguide, it has no "sidewalls" so that scattering losses are reduced. Ohmic conductor losses are reduced substantially below those in an equivalent microstrip structure, permitting operation at higher frequencies. Further, the amount by which they are reduced increases as the frequency is increased. In the example presented, the conductor losses are 56% of their microstrip contributions at 75 GHz. At 100 GHz, they are 33% of their microstrip contributions. This is a significant result since conductor losses are known to increase with increasing frequency.

It was earlier remarked that in the planar dielectric waveguide, including the strip-loaded guide, the dominant $TM_o$ mode is not widely separated from the $TE_o$ mode. The addition of metal conductors in the manner shown widens the separation between these modes, thus permitting single-mode operation over a wider band. The actual separation is determined by the ratio $h/(d_s+d_1)$. A larger ratio results in a wider separation between the modes and hence, a wider operating bandwidth. Note that this condition is independent of the dielectric materials chosen if $\epsilon_s=\epsilon_1$. This entire phenomenon was not previously anticipated.

The thickness of a microstrip substrate is limited because of the need to suppress the spurious substrate modes, as indicated previously. The most troublesome among these modes is the $TE_o$ mode for a grounded dielectric slab. The structure of this invention suppresses the propagation of this $TE_o$ mode, thus permitting the use of thicker substrates at a given operating frequency than would be possible with a comparable microstrip guide. As a result, losses at waveguide bends and waveguide discontinuities will be greatly reduced.

As illustrated by the example, the dimensions of the waveguide at the frequency range of 75–100 GHz will be larger than those of a microstrip structure designed for that range. The choices of the guiding layer 32 thickness h, the substrate dielectric 30 thickness $d_s$, and the loading strip 33 thickness $d_1$, are determined by the desired frequency of operation and by the dielectric permittivities $\epsilon_g$, $\epsilon_s$ and $\epsilon_1$. At a given operating frequency, a larger difference $\epsilon_g-\epsilon_s$ or $\epsilon_g-\epsilon_1$, will lead to smaller values of h, $d_s$ and $d_1$. For example, if $\epsilon_s=\epsilon_1=6.6\epsilon_o$ (Corresponds to BeO)

$\epsilon_g=12.9\epsilon_o$ (Corresponds to GaAs)

then $h=0.012''$, $d_s=d_1=0.010''$ in order to yield a waveguiding structure of identical performance to the one quoted in the example. Thus, the advantage of thicker substrate material is surrendered somewhat if a large dielectric discontinuity exists at the relevant interfaces.

Any or all of the dielectric elements of this structure may be semiconductors. Another unexpected result that emerges from a consideration of the new structure, particularly when semiconductors are used, is a method for exciting the dominant mode. The conventional shunt and series excitation in microstrip line are well known. In the present guide, however, another excitation method exists. The excitation source may be located at the interface between guiding layer 32 and substrate dielectric 30 or at the interface between guiding layer 32 and strip 33. The excitation source would be oriented with its current transport direction parallel to the desired direction of propagation of the energy vis., parallel to the longitudinal axis of the strip.

This method of excitation is useful because: (i) the interface is the natural location of a device integrated on a semiconductor guiding layer 32; (ii) substrate 30 and strip 33 would provide dc isolation of transmission line conductors 31 and 34 from such a device. This is a convenient feature which adds to the design flexibility of the structure.

In many respects, the transmission line of this invention resembles microstrip, with the closeness of the resemblance under the designer's control. At low frequencies, its behavior is identical to microstrip. In effect, this structure may be viewed as a means to extend the frequency of operation of microstrip circuits without having to change the substrate thickness. Thus, a 70 mil thick conventional microstrip configuration is usable from dc to 14 GHz; the 70 mil compound dielectric slab presented in the design example above is usable from dc to 100 GHz.

The characteristic impedance of the transmission line of this invention is determined primarily by the ratio of the width of the strip W, to the effective guiding layer thickness when the width is small compared to the wavelength. For larger widths, more complicated field analysis is required to define the impedance level, which is dependent on the operating frequency. However, this change is not very large. In the design example presented, a 50Ω line at 75 GHz becomes a 64Ω line at 100 GHz. Smaller variations in impedance are possible with alternative designs.

In the structure of FIG. 4, an appreciable amount of energy is propagated in the guiding and the substrate layers where no "sidewall" losses are manifested. A smaller proportion of energy is present in strip 33. This energy is subjected to sidewall scattering loss. Besides, the fields at the edges of the conducting strip are relatively higher, so that the scattering losses could be greater.

Figure 5:
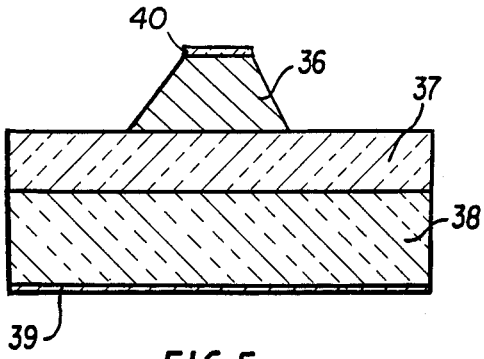
FIG. 5 shows a cross-section view of another version of the transmission line of this invention.

A solution to this problem is to taper the sides of the dielectric strip so that its cross section is no longer rectangular. FIG. 5 shows the special case of a symmetric linear taper so that strip 36 has the cross section of an isosceles trapezoid. The rest of the configuration is similar to that previously described. Strip 36 rests on guiding slab layer 37 which is in turn mounted on substrate dielectric layer 38. Ground plane 39 is coated on the bottom of layer 38. The upper face of strip 36 is clad with a metal layer 40. A variety of other tapers may also be used for strip 36 such as concave and convex circular, concave and convex hyperbolic, exponential, etc.

This technique has some latent advantages:

(i) It permits a wider range of conductor linewidths and realized, without running into the mechanical difficulty of having to mount very thin strips edge-on the guiding layer.

(ii) The tapered sides "soften" the discontinuity at the strip's edge. This has the effect of focussing the energy towards the center of the strip. This focussing effect is increased if the taper is such that the slope at any point on it relative to the vertical is greater than the critical angle for that interface. The tapered sides also increases the separation between the $TE_o$ and $TM_o$ modes beyond the effect previously described. Thus, a wider operating bandwidth is permitted. Alternatively, for a given operating bandwidth, the conductor losses may be reduced even further.

One of the anticipated disadvantages is the sensitivity of the propagating energy to imperfections of the tapered sides. This is expected to be more critical for high impedance (narrow conductor width) lines. However, such sensitivity will have a smaller impact than any corresponding effect in a competitive planar dielectric waveguide.

The wide bandwidth afforded by the waveguide of this invention makes the medium ideally suited for digital transmission.

One or more of the dielectric layers may be replaced by a non-reciprocal medium, such as a ferrite, a ferroelectric material, or an electro-optic material. The relatively small volumes in which the propagating waves are confined would enable one to use smaller amounts of control energy, and yet maintain the control energy density (energy/volume) at high enough levels to manipulate the guided energy. In practice, this means that one may use smaller magnetic field strengths to manipulate the high frequency energy in devices such as ferrite phase shifters and modulators, as well as in circulators and isolators.

The heat dissipation problem outlined earlier can be more effectively overcome by using materials like BeO, that are electrical insulators but thermal conductors, for the substrate dielectric and/or dielectric strip. Since these materials can be brought in direct contact with the power-generating device, they can serve as a low thermal resistance path between the device and a heat sink.

Semiconductor materials could be used as active and/or guiding layers. This development could lead to the implementation of mm-wave functions in a monolithic manner. Active and passive sources could be integrated into the semiconductor. Active devices should be aligned so that their current path is colinear with the long axis of the transmission line in order that energy may be effectively coupled to the line. The new waveguiding medium thus has the potential for realizing complete circuit and system functions on a single semiconductor wafer—in other words, it is compatible with monolithic integration.

The transmission line of this invention is a versatile concept. The examples described above are only illustrative of specific embodiments of the invention and various other modifications will suggest themselves to those skilled in the art which are also within the spirit and scope of the invention.

I claim:

1. An electromagnetic wave transmission line comprising:

(a) a dielectric substrate layer of permittivity $\epsilon_s$, and having first and second parallel surfaces;

(b) a conducting coating on said substrate layer second surface;

(c) a dielectric guiding slab layer of permittivity $\epsilon_g$, where $\epsilon_g > \epsilon_s$, having first and second parallel surfaces of a predetermined dimension, said guiding slab layer having its second surface attached to said substrate layer first surface;

(d) an elongated dielectric strip of permittivity $\epsilon_1$ where $\epsilon_g > \epsilon_1$, having first and second parallel surfaces which are substantially narrower than said predetermined dimension, said dielectric strip having its second surface contiguous to said first surface of said guiding slab layer, the elongated dimension of said dielectric strip defining the electromagnetic wave direction of transmission; and (e) a conducting coating on said dielectric strip first surface, whereby single mode propagation is permitted over a relatively wide band and propagation of undesired modes in said substrate layer is suppressed and the characteristic impedance varies relatively little over a wide frequency range.

2. The transmission line of claim 1 wherein at least one of said substrate layer, said guiding slab layer and said strip are semiconductors.

3. The transmission line of claim 1 wherein at least one of said substrate layer, said guiding slab layer and said strip are non-reciprocal materials.

4. The transmission line of claim 1 wherein at least one of said substrate, said guiding slab and said strip are thermal conductors but electrical insulators.

5. The transmission line of claim 1 wherein there are surfaces of said strip other than said first and second parallel surfaces which are not perpendicular to said parallel surfaces.

6. The transmission line of claim 5 wherein said first parallel surface of said strip is narrower than said second parallel surface of said strip.

7. The transmission line of claim 5 wherein all surfaces of said strip are planar.

* * * * *